US005598203A

United States Patent [19]

Choi

[11] Patent Number: 5,598,203

[45] Date of Patent: Jan. 28, 1997

[54] LASER IRRADIATION DEVICE OF LASER PRINTERS

[75] Inventor: Hoon B. Choi, Seoul, Rep. of Korea

[73] Assignee: Goldstar Co., Ltd., Seoul, Rep. of Korea

[21] Appl. No.: 143,099

[22] Filed: Oct. 29, 1993

[30] Foreign Application Priority Data

Nov. 2, 1992 [KR] Rep. of Korea ..... 1992-20427

[51] Int. Cl.[6] ..... B41J 2/47

[52] U.S. Cl. ..... 347/250; 347/259

[58] Field of Search ..... 347/250, 259, 347/258

[56] References Cited

U.S. PATENT DOCUMENTS 4,847,492 7/1989 Houki .

*Primary Examiner*—Mark J. Reinhart

*Attorney, Agent, or Firm*—Spencer & Frank

[57] ABSTRACT

This invention relates to a laser irradiation device of laser printers in which has a simplified laser diode excitation control device, comprising a laser beam emitter, a first lens for converting the laser beam emitted from the laser beam emitter into parallel laser beam, a polygonal mirror for reflecting the parallel laser beam, the polygonal mirror being rotated and having a plurality of reflection surfaces and sensing part, the sensing part sensing the starting points of each reflection surfaces, a second lens for receiving the laser beam reflected by the polygonal mL-Tor, and a controller for synthesizing an output signal from the sensing part of the polygonal mirror with a picture signal and generating control signal to control the laser beam emitter.

6 Claims, 3 Drawing Sheets

FIG. 3A
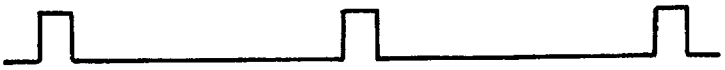
FIG. 3B
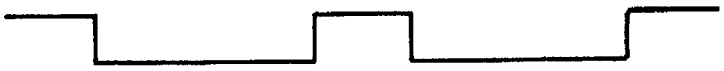
FIG. 3C
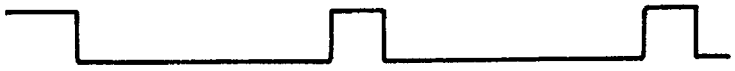
FIG. 3D
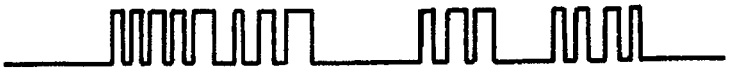
FIG. 3E
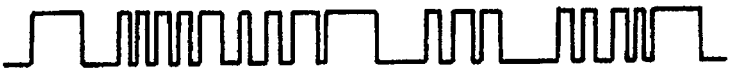
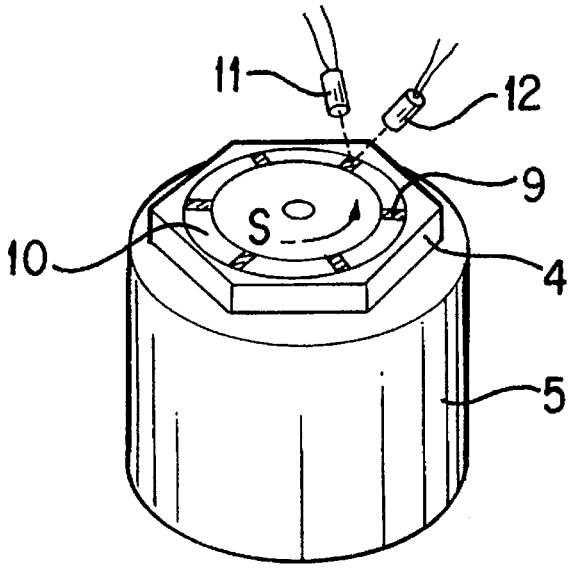
FIG. 4

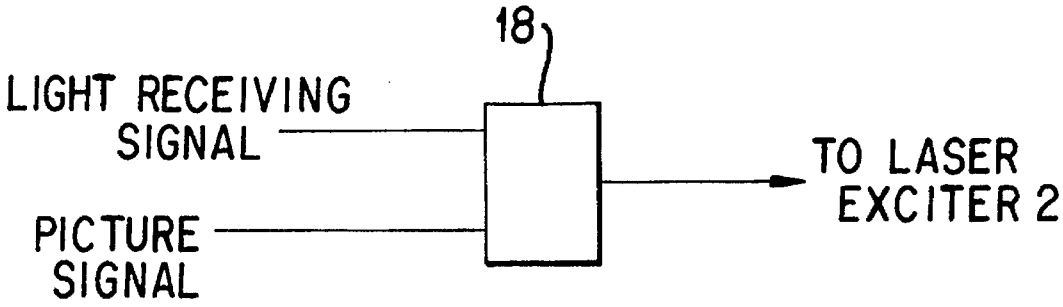
FIG. 5
FIG. 6A
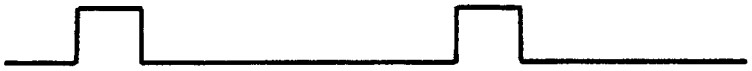
FIG. 6B
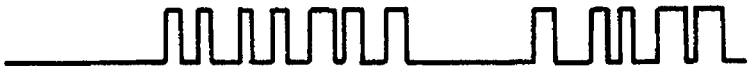
FIG. 6C
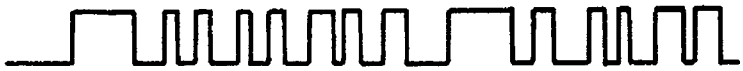

LASER IRRADIATION DEVICE OF LASER PRINTERS

FIELD OF THE INVENTION

This invention relates to a laser irradiation device of laser printers in which has a simplified laser diode excitation control device.

BACKGROUND OF THE INVENTION

Shown in FIG. 1 a schematic drawing of a conventional laser irradiation device of a laser printer including a laser diode exciter 2 exciting laser diode 1 to emit laser beam, a cylindrical lens 3 changing the diverging laser beam from the laser diode 1 into parallel laser beam, a polygonal mirror 4 changing the direction of irradiation of the incident parallel laser beam as it turns according to the lapse of time, a motor 5 driving the polygonal mirror 4, f-θ lens 6 directing the laser beam reflected at the polygonal mirror 4 to a planar surface along a irradiation direction S, a reflection mirror 7 positioned at the forward end of the irradiation surface to identify the starting points of each surfaces of the polygonal mirror 4 and a irradiation starting signal generator 8 generating irradiation starting signals in response to the laser beam reflected at the reflection mirror 7 and sensed by a light sensing element SS.

Shown in FIG. 2 is a controller controlling the excitation of the laser diode 1 including a reset signal generator 13 generating a reset signal to a counter 15 in response to the irradiation starting signal generated in the irradiation starting signal generator 8, an off signal generator 14 generating an off signal to turn-off the laser diode 1 when the irradiation starting signal is applied, a counter 15 counting the oscillation of a clock oscillator 16 for a preset number, an on signal generator 17 generating an on signal for turning-on the laser diode 1 in response to the output of the counter 15 and a signal synthesizer 18 receiving and synthesizing the on signal of the on signal generator 17, the off signal of the off signal generator 14 and a picture signal, and transmitting the synthesized signal to the laser diode exciter 2.

The laser beam generated in the laser diode 1 is directed to the polygonal mirror 4 functioning as a deflector after having changed to a parallel laser beam through the cylindrical lens 3. The polygonal mirror 4, rotating in the direction shown by the arrow S by the motor 5, changes the reflection angle according to the lapse of time repeatedly, that is, changes angular velocity to linear velocity continuously. The parallel laser beam reflected at the polygonal mirror 4 irradiate along the direction of irradiation S in a constant speed through the f-θ lens 6 for irradiating on a planar surface.

A reflection mirror 7 is positioned at the forward end of a irradiating surface for indicating the position of the laser beam as each mirror surfaces of the polygonal mirror 4 turns and the irradiation starting signal generator 8 is positioned at a fixed position in the path of the reflected laser beam. A certain pulse is generated from the irradiation starting signal generator 8 on the moment when the laser beam passes thereover, which is a signal based on which the picture signal is generated.

Herein, the laser diode 1 should be controlled to generate the irradiation starting signal on the time when the laser beam passes over the reflection mirror 7, a circuit for which is a circuit as shown in FIG. 2.

The control operation of FIG. 2 is explained referring FIG. 3. On irradiation signal input to the reset signal generator 13 and the off signal generator 14, the reset signal generator 13 generates a reset signal and transmits the reset signal to the counter 15, and the off signal generator 14 generates an off signal shown in FIG. 3(C) which is generated on the synchronization of the irradiation starting signal with a falling edge.

Then, when the counter 15, having set a value to count on receiving a counting set signal, counts the oscillation from the clock oscillator 16 to transmit the counted value to the on signal generator 17, the on signal generator 17 transmits the on signal shown in FIG. 3(B) to the signal synthesizer 18. Thereafter, the signal synthesizer 18 generates the laser diode excitation signal as shown in FIG. 3(E) which is a synthesized signal of the picture signal, the on signal and the off signal. In this time, the irradiation starting signal, independent of the polygonal mirror 4, turned-on slightly before the time when next mirror surface coming in considering the speed of rotation of the polygonal mirror 4.

However, because the generation time of the irradiation starting signal should be set slightly before the expected time measured of the starting point of the next irradiation surface, it has been a problem to require a complicated circuit as shown in the control part of FIG. 2. Further, it has a restriction in setting the value to count to change the resolution through changing the speed of the polygonal mirror, and because the oscillation of the oscillation clock should be high frequency to rectify this restriction, it also raise a problem of developing a greater noise and disturbance of the picture in the laser printer system.

SUMMARY OF THE INVENTION

The object of this invention is to provide a laser irradiation device of laser printers having simplified laser diode excitation control.

Another object of this invention is to provide a laser irradiation device of laser printers permitting a easy identification of the starting points of the each surfaces of the polygonal mirror.

These and other objects and the features of this invention can be achieved by providing a laser irradiation device of laser printers in which has a simplified laser diode excitation control device, comprising a laser beam emitter, a first lens for converting the laser beam emitted from the laser beam emitter into parallel laser beam, a polygonal mirror for reflecting the parallel laser beam, the polygonal mirror being rotated and having a plurality of reflection surfaces and sensing part, the sensing part sensing the starting points of each reflection surfaces, a second lens for receiving the laser beam reflected by the polygonal mirror, and a controller for synthesizing an output signal from the sensing part of the polygonal mirror with a picture signal and generating control signal to control the laser beam emitter.

BRIEF DESCRIPTION OF THE DRAWINGS

FIGS. 3(A) thru 3(E) show the wave patterns of each elements of FIG. 2.

FIG. 4 shows a perspective view of a polygonal mirror and the cable connections of a laser irradiation device of a laser printer according to one embodiment of this invention.

FIG. 5 is a block diagram showing a control circuit for controlling the device of FIG. 4.

FIGS. 6(A) thru 6(C) show the wave patterns of each elements of FIG. 5.

DETAILED DESCRIPTION OF THE INVENTION

FIG. 4 shows a perspective view of a polygonal mirror and the cable connections of a laser irradiation device of a laser printer according to one embodiment of this invention.

Figure 1:
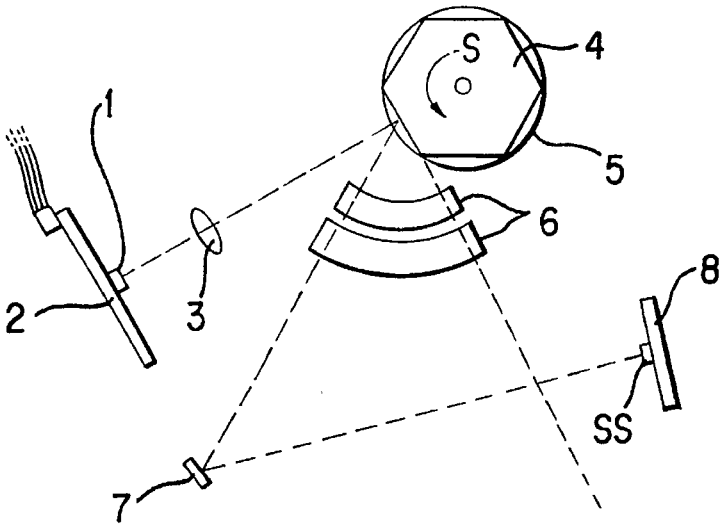
FIG. 1 is a schematic drawing showing a conventional laser irradiation device of a laser printer.
Figure 2:
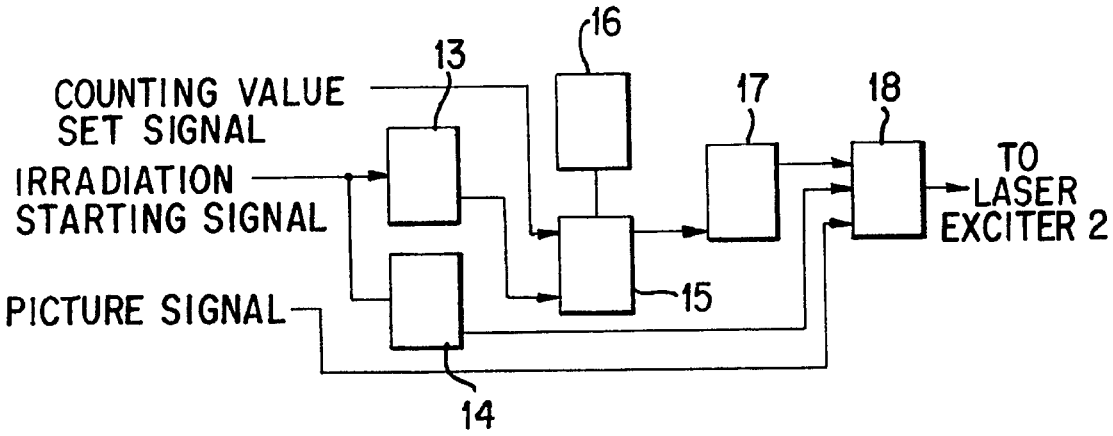
FIG. 2 is a block diagram showing a control circuit for controlling the device of FIG. 1.

The laser irradiation device of this invention is an improved device of the device shown in FIG. 1 in the part of the polygonal mirror. Light absorbing/reflecting bands 9 and 10 are formed at a certain distance from the center of the upper surface of the polygonal mirror 4, and a light emitting element 11 emitting light to the fight absorbing/reflecting bands 9 and 10 and a light receiving element 12 receiving light reflected from the light absorbing/reflecting bands 9 and 10. The light absorbing bands 9 are formed at the starting points of each surfaces of the polygonal mirror 4 and the light reflecting bands 10 are formed on the rest of the light absorbing bands 9.

The laser beam emitted from a laser diode 1 is changed to a parallel laser beam in a cylindrical lens 3. The parallel laser beam, incident to the polygonal mirror, is reflected to irradiate a planar surface through a f-θ lens 6.

In this time, the polygonal mirror 4 rotates in the irradiation direction S around the central axis while the light emitting element 11 irradiates the light absorbing/reflecting bands 9 and 10. The light absorbing bands 9 absorbs the light from the light emitting element 11 and the light reflecting bands 19 reflects the light from the light emitting element 11, which light signals of the reflections are received by the light receiving element 12 and convened into electrical signal-(wave of FIG. 6(A)) and transmitted to a signal synthesizer 18 shown in FIG. 5. This signal, synthesized with picture signal(wave of FIG. 6(B)) in the signal synthesizer 18, become laser diode excitation control signal as shown in FIG. 6(C), which is transmitted to a laser diode exciter 2.

As explained hereinbefore, according to this invention, it is possible to simplify the control of the laser diode exciter utilizing the synthesized signal of the picture signals with the electrical signals convened from the light signals indicating a certain positions of the polygonal mirror when rotating the polygonal mirror on the upper surface of which a light pattern for the identification of the positions is provided and a light emitting element and a light receiving element to sense the light pattern is provided over the polygonal mirror. Further, this invention permits the timely excitation of the laser diode without the required complicated setting of the value to count on the change of the speed of the polygonal mirror rotation by providing the rotational speed of the light pattern being always the same with the rotational speed of the polygonal mirror.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims.

What is claimed is:

1. A laser irradiation device of laser printers comprising, a laser beam emitter;

a first lens for converting the laser beam emitted from the laser beam emitter into parallel laser beam;

a polygonal mirror for reflecting the parallel laser beam, the polygonal mirror being rotatable and including (i) a plurality of reflection surfaces and (ii) sensing means mounted on and rotatable with said mirror for sensing the starting point of each one of the reflection surfaces and for generating an output signal;

a second lens for receiving the laser beam reflected by the polygonal mirror; and a controller for synthesizing said output signal from said sensing means with a picture signal and for generating a control signal to control the laser beam emitter.

2. A laser irradiation device of laser printers as claimed in claim 1, wherein the laser beam emitter includes a laser diode.

3. A laser irradiation device of laser painter as claimed in claim 1, wherein the first lens is a cylindrical lens and the second lens is a f-θ lens.

4. A laser irradiation device of laser printers as claimed in claim 1, wherein said sensing means includes light absorbing/reflecting bands positioned at a certain distance from the center of the polygonal mirror for absorbing light at the starting points of the reflection surfaces and for reflecting light in the rest of the bands, a light emitting element for emitting light to the light absorbing/reflecting bands, and a light receiving element for receiving light reflected from the light absorbing/reflecting bands.

5. A laser irradiation device of laser printers comprising, a laser beam emitter;

a first lens for converting the laser beam emitted from the laser beam emitter into parallel laser beam;

a polygonal mirror for reflecting the parallel laser beam, the polygonal mirror being rotatable and including a plurality of reflection surfaces and means for sensing the starting point of each one of the reflection surfaces and generating an output signal;

said sensing means including light absorbing/reflecting bands positioned at a certain distance from the polygonal mirror for absorbing light at the starting points of the reflection surfaces and for reflecting light in the rest of the bands, a light emitting element for emitting light to the light absorbing/reflecting bands, and a light receiving element for receiving light reflected from the light absorbing/reflecting bands;

a second lens for receiving the laser beam reflected by the polygonal mirror; and a controller for synthesizing said output signal from said sensing means with a picture signal and for generating a control signal to control the laser beam emitter.

6. A laser irradiation device of laser printer as claimed in claim 5, wherein said controller includes means for synthesizing said output signal from said sensing means with said picture signal to generate a laser diode excitation control signal, a laser diode exciter responsive to said laser diode excitation control signal for exciting said laser beam emitter, said laser beam emitter including a laser diode to emit the laser beam.

* * * * *